US009902597B2

(12) United States Patent
Huang

(10) Patent No.: US 9,902,597 B2
(45) **Date of Patent: *Feb. 27, 2018**

(54) TORQUE LIMITER FOR POWER WINCH

(71) Applicant: Comeup Industries Inc., Taipei (TW)

(72) Inventor: Shih Jyi Huang, Taipei (TW)

(73) Assignee: Comeup Industries Inc., Taipei (TW)

( * ) Notice: Subject to any disclaimer, the term of this patent is extended or adjusted under 35 U.S.C. 154(b) by 269 days.

This patent is subject to a terminal disclaimer.

(21) Appl. No.: 14/935,521

(22) Filed: Nov. 9, 2015

(65) Prior Publication Data

US 2016/0311667 A1 Oct. 27, 2016

(30) Foreign Application Priority Data

Apr. 24, 2015 (TW) ..... 104206236 U
Apr. 27, 2015 (CN) ..... 2015 2 0260306 U

(51) Int. Cl.

| | |
|---|---|
| ***B66D 1/14*** | (2006.01) |
| ***B66D 1/12*** | (2006.01) |
| ***B66D 1/00*** | (2006.01) |
| ***B66D 1/22*** | (2006.01) |
| ***B66D 1/58*** | (2006.01) |

(52) U.S. Cl.

CPC ..... *B66D 1/14* (2013.01); *B66D 1/00* (2013.01); *B66D 1/12* (2013.01); *B66D 1/22* (2013.01); *B66D 1/58* (2013.01)

(58) Field of Classification Search

CPC ... B66D 1/00; B66D 1/12; B66D 1/14; B66D 1/16; B66D 1/22; B66D 1/58

USPC ..... 254/274, 344

See application file for complete search history.

(56) References Cited

U.S. PATENT DOCUMENTS

| | | | | | |
|---|---|---|---|---|---|
| 3,985,047 | A * | 10/1976 | Therkelsen | B66D 1/14 | 254/354 |
| 3,986,588 | A * | 10/1976 | Kuzarov | B66D 1/16 | 188/218 XL |
| 4,004,780 | A * | 1/1977 | Kuzarov | B66D 1/16 | 254/345 |
| 4,461,460 | A * | 7/1984 | Telford | B66D 1/22 | 188/337 |
| 4,545,567 | A * | 10/1985 | Telford | B66D 1/22 | 188/337 |
| 4,736,929 | A * | 4/1988 | McMorris | B66D 1/22 | 254/323 |
| 5,261,646 | A * | 11/1993 | Telford | B66D 5/08 | 188/343 |
| 5,638,935 | A * | 6/1997 | Fehring | F16D 43/10 | 192/105 B |

(Continued)

*Primary Examiner* — Michael E Gallion
(74) *Attorney, Agent, or Firm* — Alan D. Kamrath; Kamrath IP Lawfirm, P.A.

(57) ABSTRACT

Disclosed is a torque limiter for a power winch, and a torque limit mechanism is installed for timely cut off the power transmission whenever the reverse torque generated by a carrying load exceeds a torque bearable by the power supply during a power transmission process for transmitting the power outputted from a power supply to a reduction mechanism through a long shaft, so as to prevent the power supply from being damaged by overload. The torque limit mechanism is formed by a torsion shaft, a friction plate, a brake pad, a disc-shaped elastic member, an adjustable positioning ring and a positioning screw ring.

4 Claims, 13 Drawing Sheets

(56) References Cited

U.S. PATENT DOCUMENTS

| | | | | |
|---|---|---|---|---|
| 6,604,731 | B2 * | 8/2003 | Hodge | B66D 1/22 254/344 |
| 7,000,904 | B2 * | 2/2006 | Huang | B66D 1/22 254/323 |
| 7,222,700 | B2 * | 5/2007 | Elliott | F16D 67/00 188/166 |
| 7,270,312 | B1 * | 9/2007 | Phipps | B66D 1/22 254/278 |
| 7,374,153 | B2 * | 5/2008 | Huang | B66D 5/02 254/267 |
| 7,568,559 | B2 * | 8/2009 | Huang | B66D 5/06 188/72.7 |
| 7,703,751 | B2 * | 4/2010 | Elliott | B66D 1/22 254/344 |
| 7,891,641 | B1 * | 2/2011 | Miller | B66D 1/16 254/344 |
| 7,922,153 | B2 * | 4/2011 | Zhou | B66D 1/22 254/323 |
| 8,434,742 | B2 * | 5/2013 | Akhavein | B66D 3/006 254/344 |
| 8,973,902 | B2 * | 3/2015 | Huang | F16D 11/16 254/355 |
| 9,266,702 | B2 * | 2/2016 | Fretz | B66D 1/02 |
| 9,487,381 | B2 * | 11/2016 | Huang | B66F 3/44 |
| 2003/0001148 | A1 * | 1/2003 | Huang | B66D 5/22 254/378 |
| 2008/0000735 | A1 * | 1/2008 | Huang | B60T 13/02 188/171 |
| 2014/0174879 | A1 * | 6/2014 | Huang | F16D 11/16 192/71 |
| 2016/0068376 | A1 * | 3/2016 | Fretz | B66D 3/00 254/219 |
| 2016/0311667 | A1 * | 10/2016 | Huang | B66D 1/12 |

* cited by examiner

TORQUE LIMITER FOR POWER WINCH

BACKGROUND OF THE INVENTION

Field of the Invention

The present invention relates to a torque limiter for a power winch, and more particularly to the torque limiter applied to a power winch and capable of timely cutting off the power whenever the reverse torque produced by a carrying load exceeds the bearable torque of the power supply, so as to prevent the power winch from being damaged by overload.

Description of the Related Art

Power winch is a device designed for hanging or dragging a load. For example, a hoist is a common application of the power winch, and a cable winch installed at the front of a jeep or a cross-country vehicle for trailing another car (to help others) or moving out of danger (to rescue oneself) is another common application of the power winch. The principle of operating the power winch is to output a forward or reverse transmission power by a power supply (such as a power motor) and acted by a reduction mechanism to drive a cable wheel to rotate in a forward or reverse direction to release or retrieve a cable, and a load (such as a heavy object, another car, or another object) is hooked by a heavy-duty hook installed at a front end of the cable, so as to move the load conveniently.

Since the winch carries a load (such as goods, objects, or people waiting to be rescued), and the load sometimes exceeds the torque bearable by the power supply (which involves the loading capacity of the power supply), therefore a torque limit mechanism for preventing any torque produced by the load and unbearable by the power supply is generally installed in a transmission mechanism, such that if an overload occurs, the torque limit mechanism will rotate idly and slip and will no longer transmit power, so as to protect the transmission mechanism (such as a power motor, a reduction mechanism, etc) of the power winch, and prevent the components of the power winch from being damaged by the overload. However, the conventional power winch generally uses a conventional circuit breaker as the torque limit mechanism, such that when the torque of the load increases, the current of the power supply current also increases. Therefore, the power of the power supply will be disconnected when there is an overload of current, so as to provide the effect of limiting the torque indirectly. However, the circuit breaker cannot be turned off or on immediately when the circuit breaker is used as a torque limit mechanism, due to the time lapse. Therefore, the power of the power winch cannot be stopped immediately when there is an overload, but the output of power will continue for a short period of time before the power winch stops. Obviously, such application causes tremendous trouble to users and requires further improvements.

SUMMARY OF THE INVENTION

Therefore, it is a primary objective of the present invention to provide a torque limiter for a power winch, so that when a carrying load produces a reverse load exceeding the load bearable by the power supply, the power will be cut off immediately to prevent the power winch from being damaged by overload.

To achieve the aforementioned and other objectives, the present invention provides a torque limiter for a power winch, and the torque limiter comprises: a frame, a power supply installed on a side of the frame and capable of outputting power; a reduction gearbox installed on the other side of the frame and including a reduction mechanism installed therein, and a long shaft being driven to rotate by the power of the power supply to provide a reduction effect, and an end of the long shaft forming a latching end; a cable wheel installed at the middle of the frame and driven to rotate by the power outputted by the reduction gearbox; and a torque limit mechanism being installed in a process of transmitting power from the power supply to the reduction mechanism through the long shaft; characterized in that the torque limit mechanism is comprised of a torsion shaft, a friction plate, a brake pad, a disc-shaped elastic member, an adjustable positioning ring, and a positioning screw ring, wherein the torsion shaft includes an axial through slot formed therein, a latching slot formed at a front end of the torsion shaft, a threaded section formed on an outer periphery of the torsion shaft, and positioning cavity axially and deeply penetrated into the torsion shaft; the friction plate is a ring-shaped plate with friction surfaces; the brake pad is a ring-shaped plate made of a lining material and having a positioning protrusion formed at the inner periphery of the brake pad; the disc-shaped elastic member is substantially in a concave arc shape and has compressive elasticity; the outer periphery of the adjustable positioning ring includes a plurality of positioning plates and selectively bent in a direction towards the positioning screw ring; the positioning screw ring has a shaft hole with a reverse inner thread, and the outer periphery has a plurality of symmetrical positioning grooves formed thereon and provided for deviating, pressing, and remaining the selected positioning screw plate therein.

In the torque limiter for a power winch, the torque limit mechanism has an inner housing installed in front of the reduction mechanism in the reduction gear for entering power and coupled to the reduction mechanism, and a through hole formed at an end of the inner housing, and during assembling, the torsion shaft is passed through the friction plate and the through hole of the inner housing, so that the friction plate is attached to the torsion shaft, and the through slot of the torsion shaft is sheathed on the long shaft, and a latching end at an end of the long shaft is inserted into and closely coupled to the latching slot of the torsion shaft, and the brake pad is mounted onto the torsion shaft outside the inner housing, and the positioning protrusion is entered into the positioning cavity, and the disc-shaped elastic member, the adjustable positioning ring and the positioning screw ring are sheathed on the torsion shaft sequentially, and the shaft hole of the positioning screw ring is screwed and coupled to the threaded section, until the torsion shaft, the friction plate, the inner housing, the brake pad, the disc-shaped elastic member, the adjustable positioning ring and the positioning screw ring are packed tightly, and the positioning plate of the adjustable positioning ring is bent and pressed into the corresponsive positioning groove of the positioning screw ring to limit and prevent the positioning screw ring from being rotated or withdrawn.

In the torque limiter for a power winch, the torque limit mechanism is installed in the assembly of the reduction mechanism, and the reduction mechanism has a first planetary gear set comprising three identical small gears with a common center shaft inserted into a base and a cover and arranged into a triangular shape, and the base has a through hole formed at the center of the base, and a large accommodating slot formed on a surface of the base and facing the small gears and connected to plurality of small cavities formed on the inner periphery of the base; and the cover has a through hole corresponsive to the through hole of the base, and the outer periphery of the friction plate further includes a plurality of small flanges, such that during assembling, the torsion shaft is passed through the disc-shaped elastic member and the brake pad, and the positioning protrusion of the brake pad is entered into the positioning cavity of the torsion shaft, and then the torsion shaft is passed through the through hole of the base, so as to attach the brake pad onto the back side of the base, and the friction plate is contained into the large accommodating slot of the base in the manner of corresponding the small flanges one by one to the small cavities and provided for passing the torsion shaft, and then the adjustable positioning ring and the positioning screw ring are sheathed on the torsion shaft sequentially, so that the shaft hole of the positioning screw ring is screwed and engaged with the threaded section until the torsion shaft, the disc-shaped elastic member, the brake pad, the base, the friction plate, the adjustable positioning ring and the positioning screw ring are packed closely, and the positioning plate of the adjustable positioning ring is bent and pressed into the corresponsive positioning groove of the positioning screw ring to limit and prevent the positioning screw ring from being rotated and withdrawn.

In the torque limiter for a power winch, when the torque limit mechanism is installed at the power supply that outputs power, a sleeve is coupled to the center shaft of the power supply, and a large accommodating slot is formed at an end of sleeve away the shaft, and the outermost section of the inner periphery of the large accommodating slot has a plurality of small cavities, and the outer periphery of the friction plate has a plurality of small flanges, such that during assembling, the torsion shaft is passed through the friction plate, the brake pad, the disc-shaped elastic member, the adjustable positioning ring and the positioning screw ring sequentially, so that the friction plate is attached onto the torsion shaft, and the positioning protrusion of the brake pad is entered into the positioning cavity of the torsion shaft, and the shaft hole of the positioning screw ring is screwed and engaged with the threaded section of the torsion shaft until the torsion shaft, the friction plate, the brake pad, the disc-shaped elastic member, the adjustable positioning ring and the positioning screw ring are packed closely, and the positioning plate of the adjustable positioning ring is bent and pressed into the corresponsive positioning groove of the positioning screw ring to limit and prevent the positioning screw ring from being rotated and withdrawn, and then the torque limit mechanism is contained in the large accommodating slot of the sleeve, and the small flanges of the friction plate are inserted and positioned into the small cavities of the sleeve in one-to-one correspondence, and the latching end of the long shaft is inserted into the latching slot of the torsion shaft for a connection.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

The present invention provides a torque limit mechanism installed during a transmission process of a power winch and provided for timely cutting off the power transmission whenever the torque produced by a carrying load exceeds a torque bearable by the power supply, so that the torque limit mechanism may be installed at any position in the power transmission process. For example, the torque limit mechanism is installed before the power is entered into the reduction gearbox (in other words, it is installed at the front of the reduction mechanism), or it is directly installed in the assembly of reduction mechanism, or it is installed when power is outputted by the power supply, and the preferred embodiments are described in details below.

Figure 1:
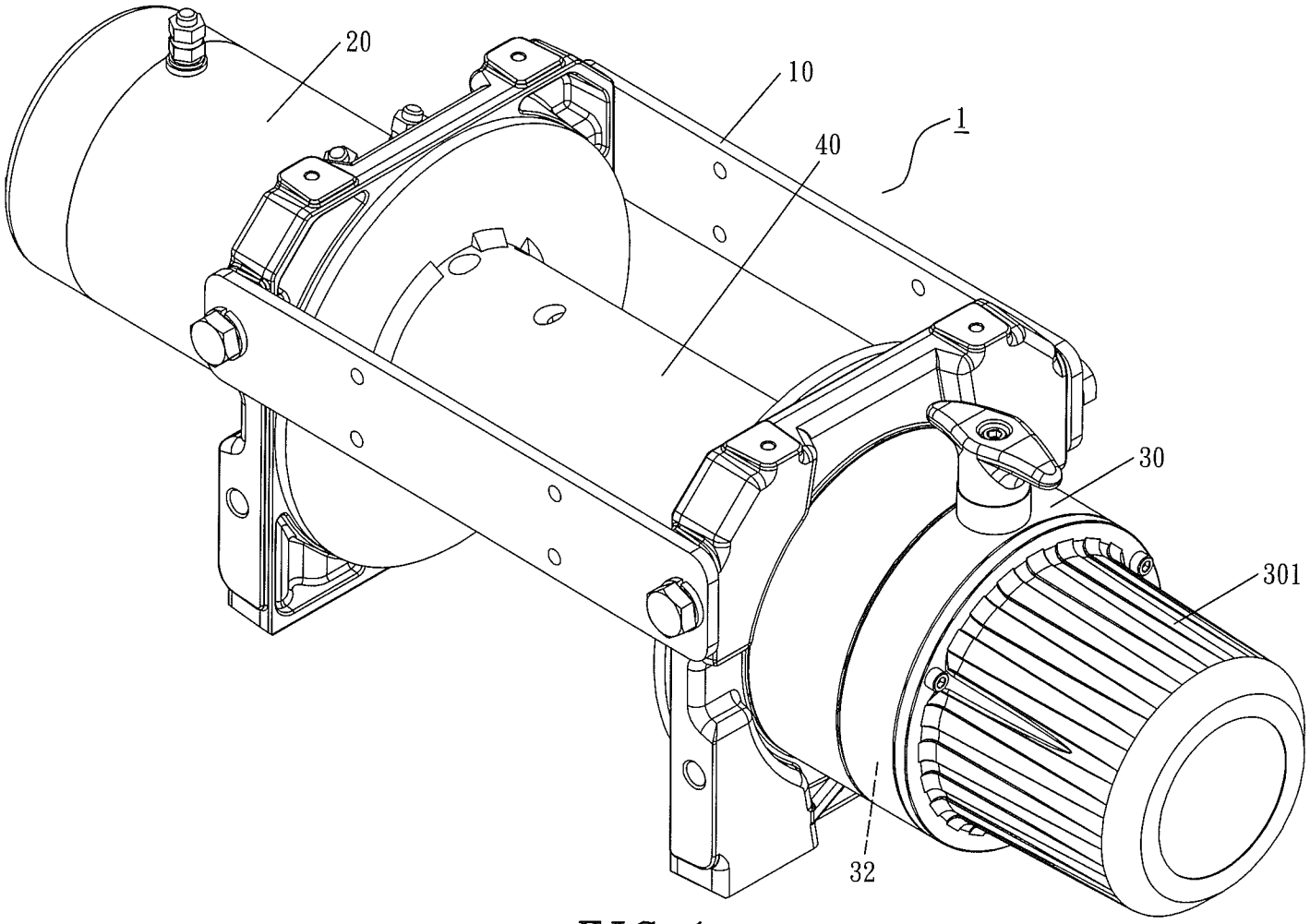
FIG. 1 is a perspective view of a first preferred embodiment of the present invention.

In the first preferred embodiment, the torque limit mechanism is installed in front of the reduction mechanism in the reduction gearbox for entering the power (in other words, it is installed at the front of the reduction mechanism). With reference to FIG. 1 for a power winch 1 in accordance with the first preferred embodiment of the present invention, the overall appearance of the structure of the power winch 1 comprises: a frame 10; a power supply 20, such as a power motor installed on a side of the frame 10, and capable of outputting a forward power or a reverse power; a reduction gearbox 30 installed on the other side of the frame 10, and including a reduction mechanism 32 (as shown in FIG. 5) installed therein, for receiving the power transmission from the power supply 20 for reduction; and a cable wheel 40 installed at the middle of the frame 10 and driven to rotate by the power outputted from the reduction gearbox 30, so as to release a cable (not shown in the figure) or retrieve the cable.

Figure 2:
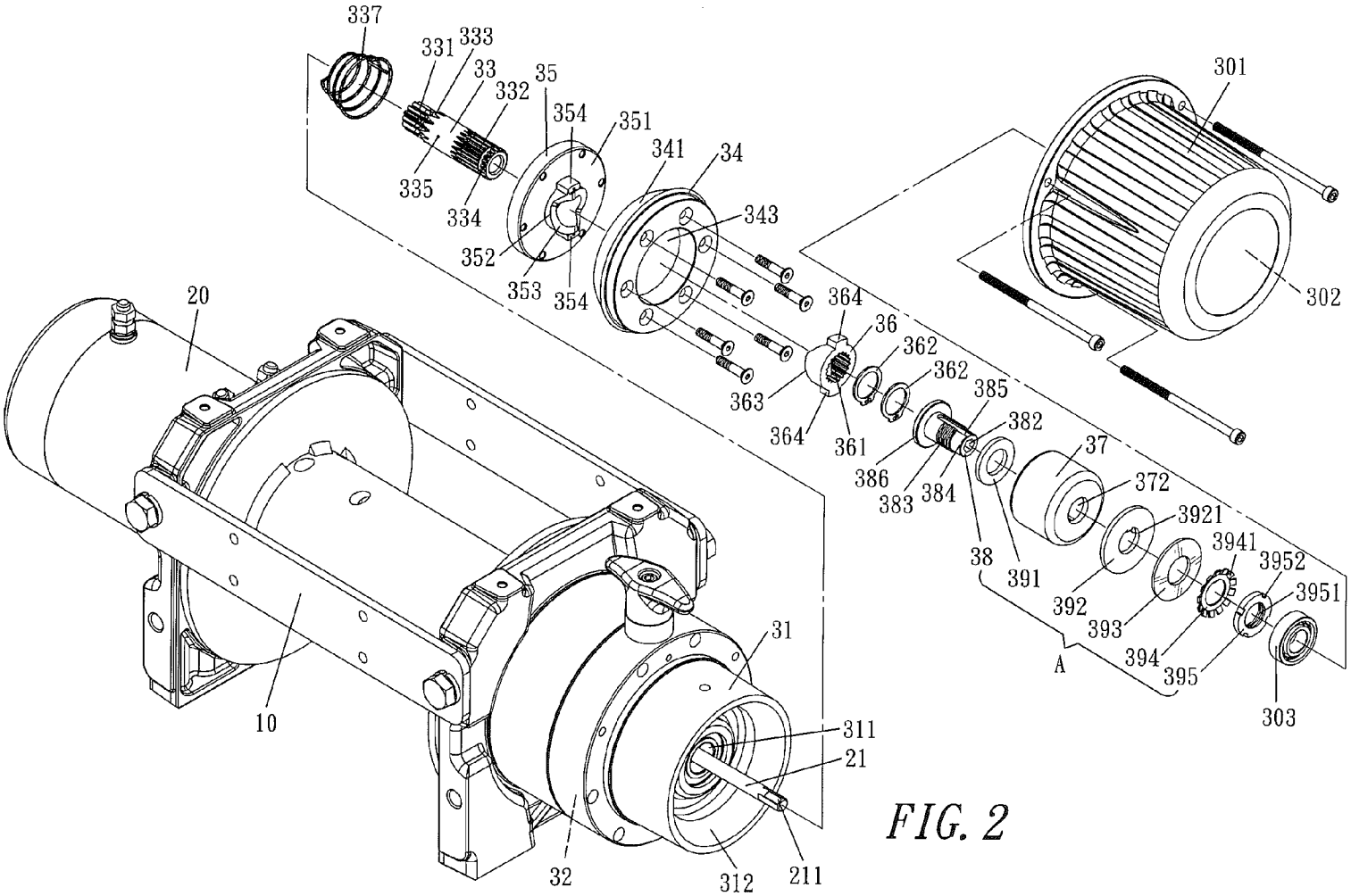
FIG. 2 is an exploded view of the first preferred embodiment of the present invention.
Figure 3:
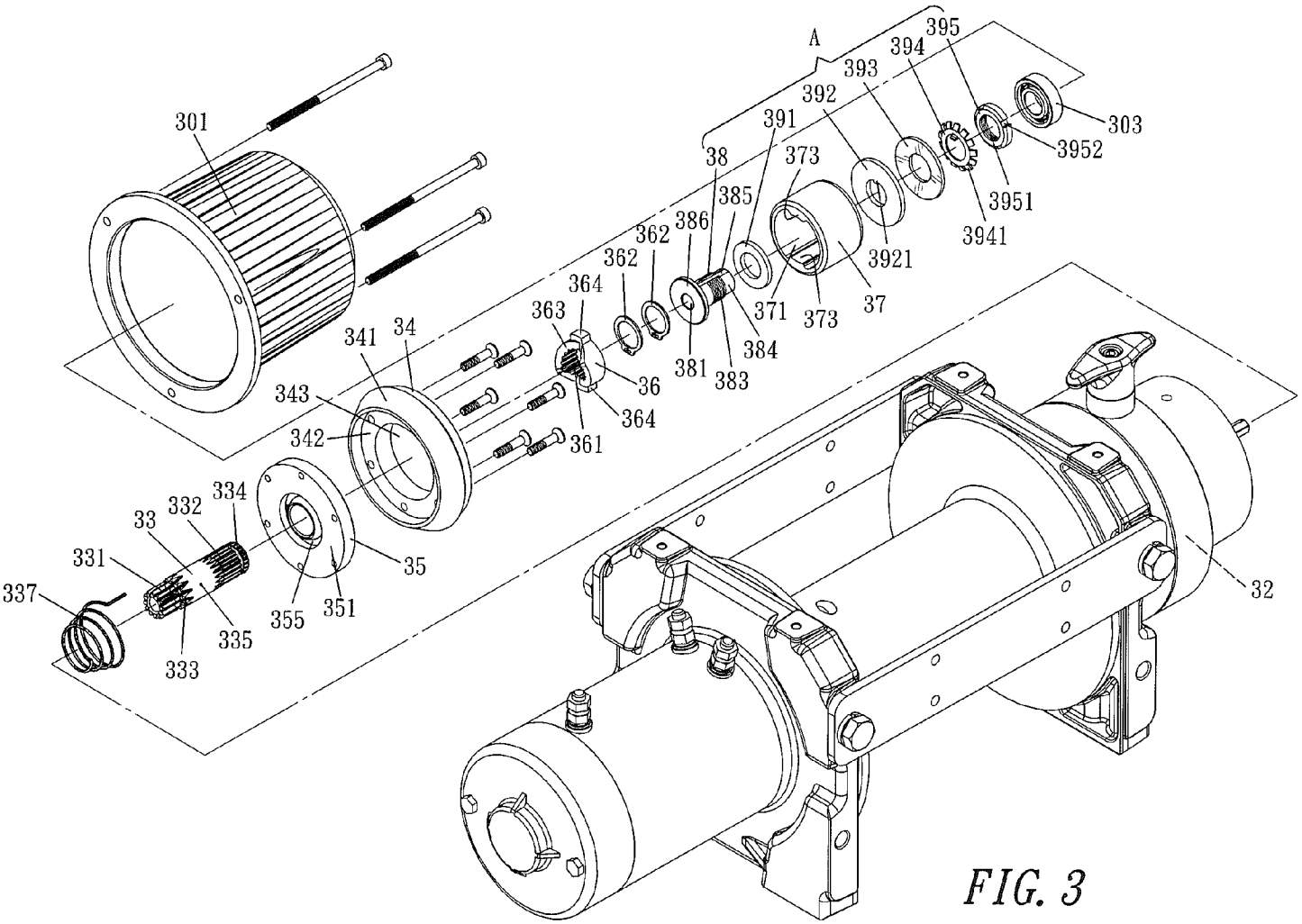
FIG. 3 is an exploded view of the first preferred embodiment of the present invention, viewing from another angle.
Figure 4:
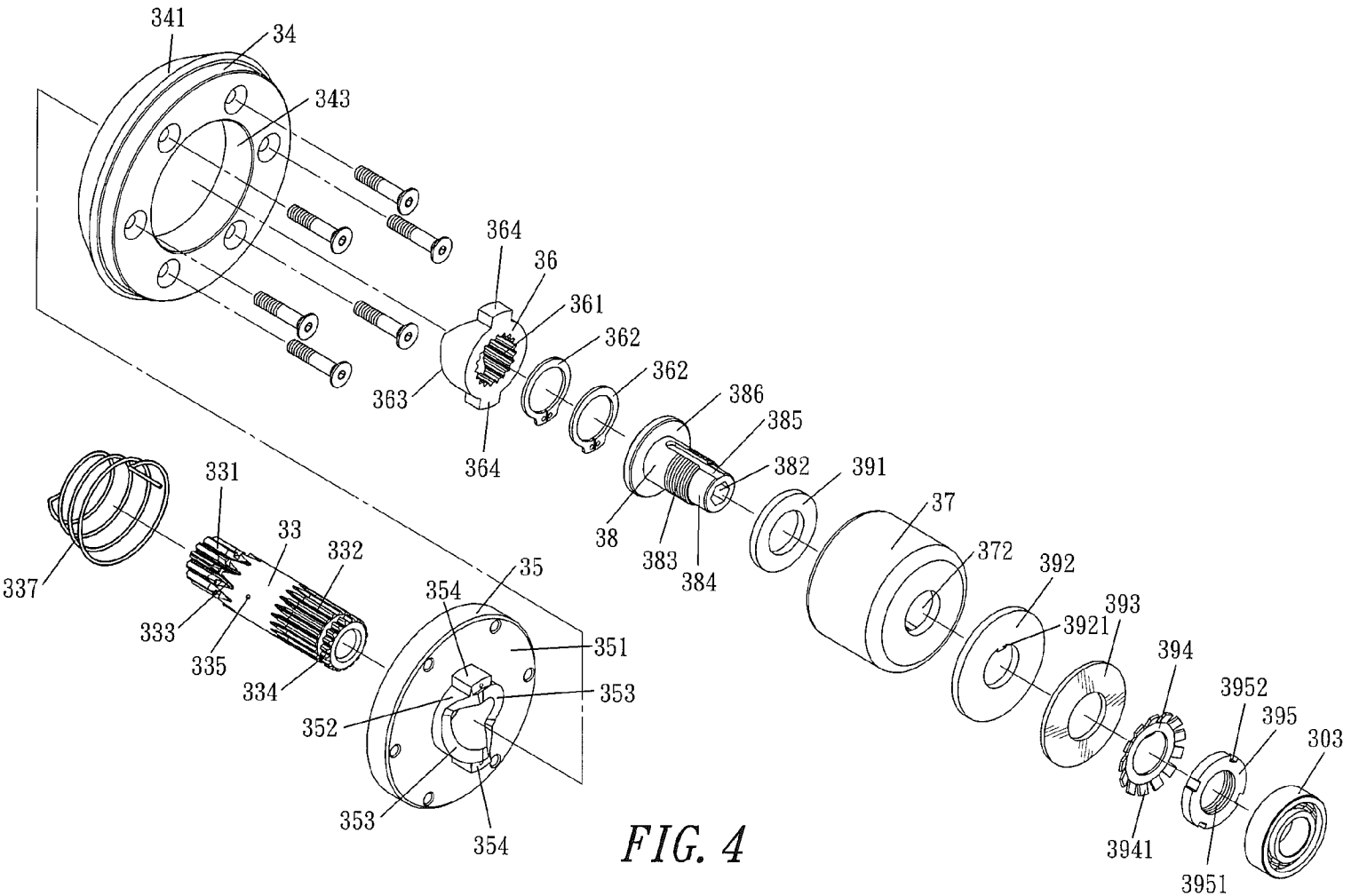
FIG. 4 is an exploded view of a torque limit mechanism of the first preferred embodiment of the present invention.
Figure 5:
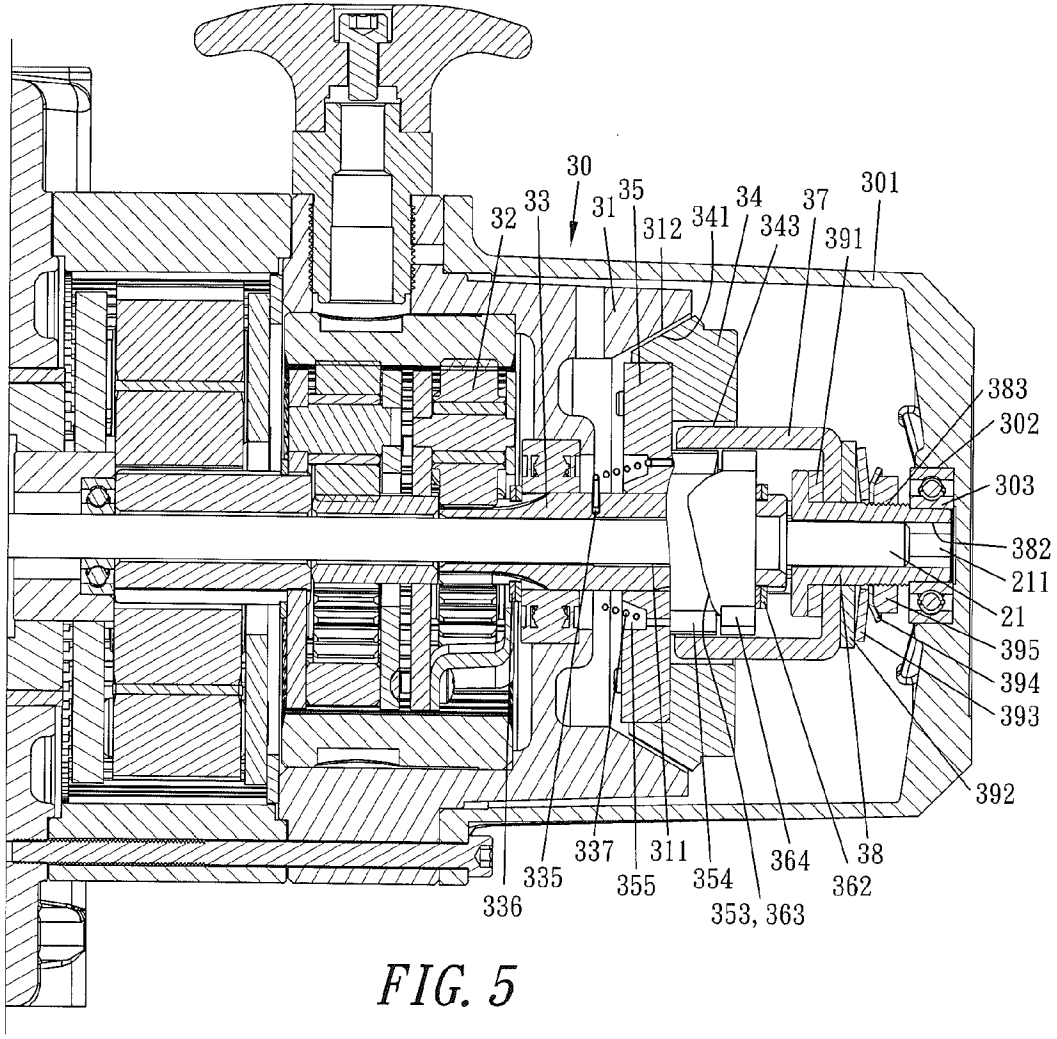
FIG. 5 is a cross-sectional view of the first preferred embodiment of the present invention.
Figure 6:
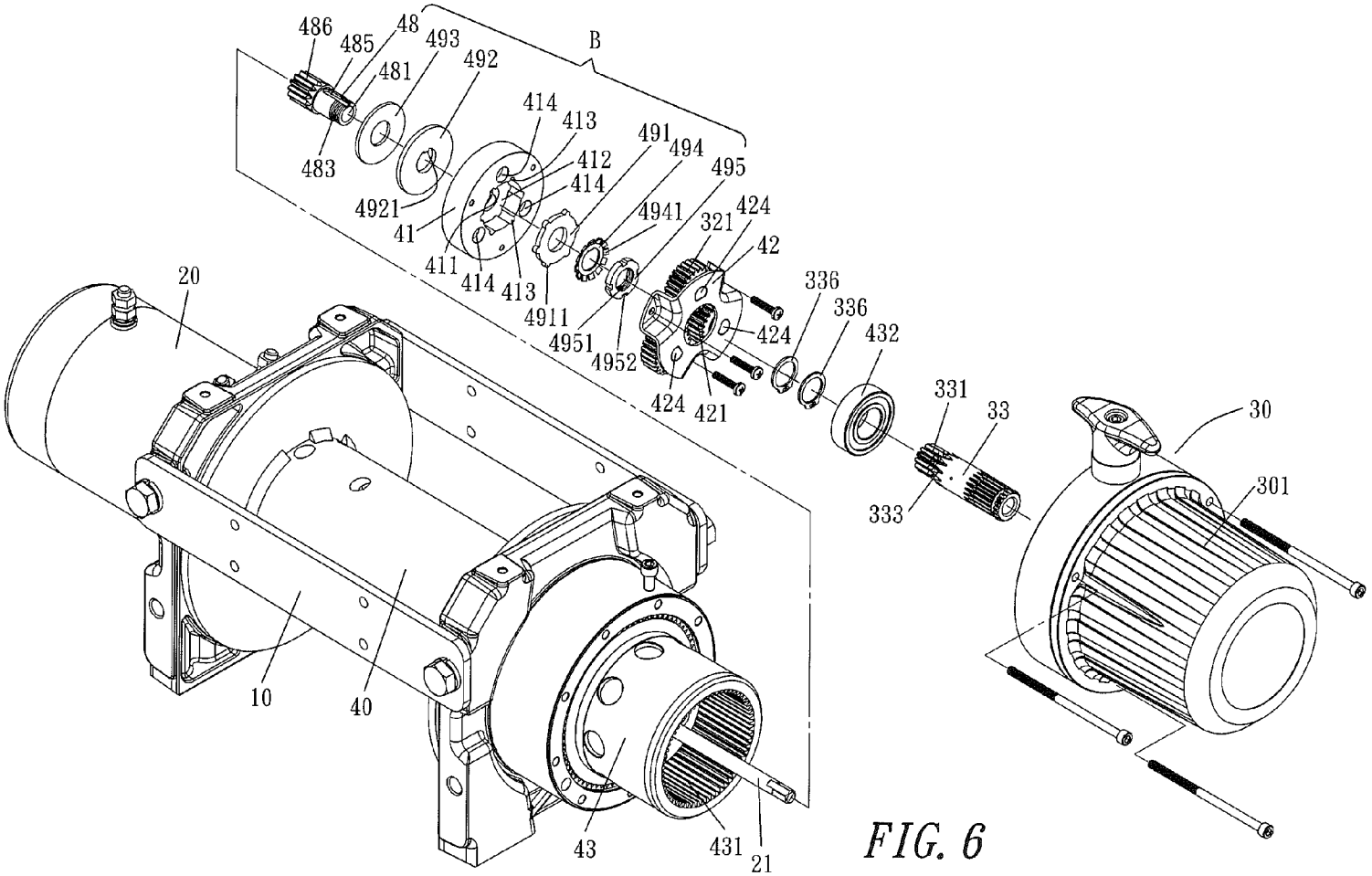
FIG. 6 is an exploded view of a second preferred embodiment of the present invention.
Figure 7:
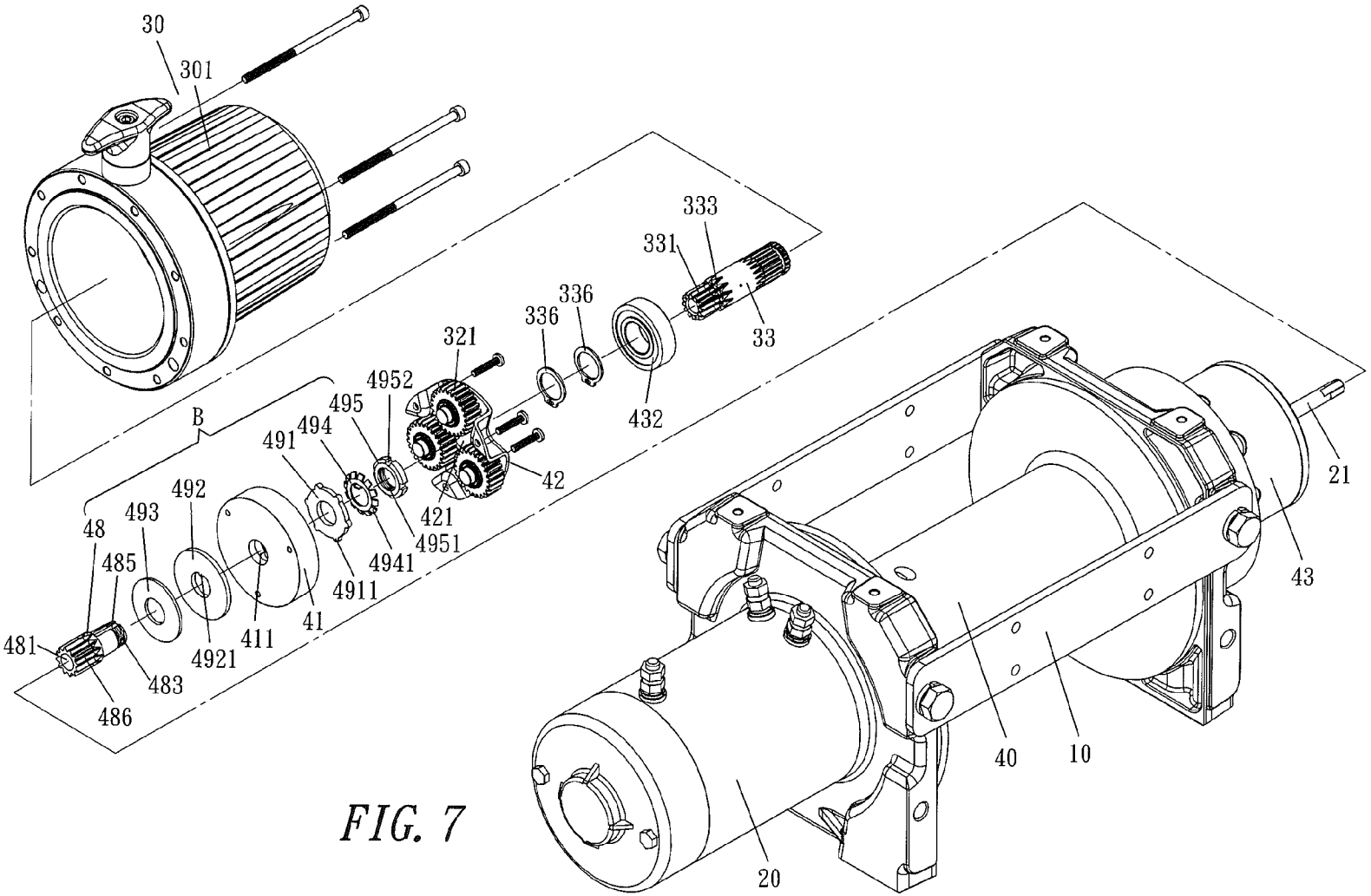
FIG. 7 is an exploded view of the second preferred embodiment of the present invention, viewing from another angle.
Figure 8:
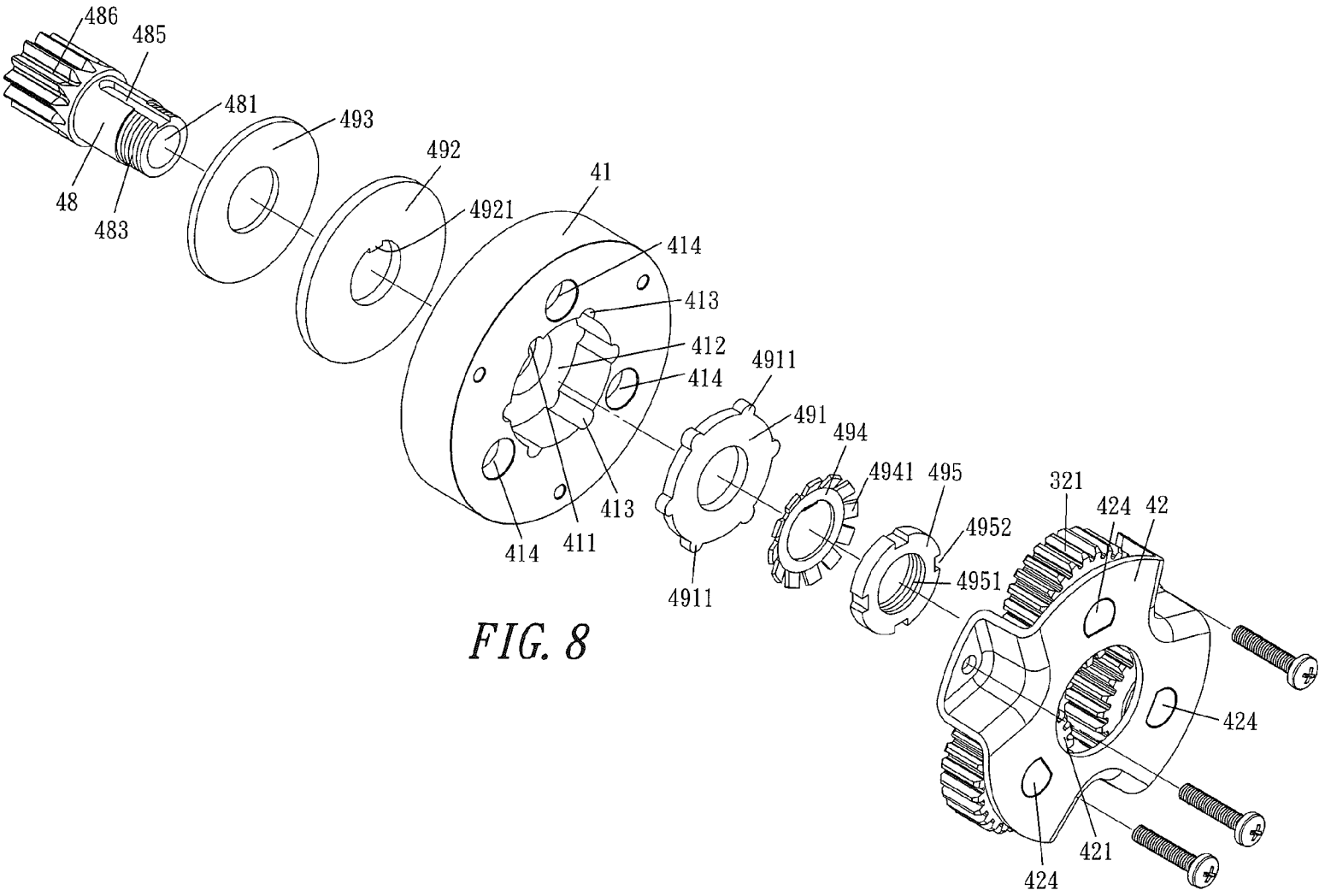
FIG. 8 is an exploded view of a torque limit mechanism of the second preferred embodiment of the present invention.

In FIGS. 2 to 5, after a rear cover 301 of the reduction gearbox 30 is removed, a long shaft 21 is directly and synchronously driven by a center shaft of the power supply 20 and extended out from a central through hole 311 of an inner circular shell 31, and an end of the long shaft 21 is formed as a non-circular latching end 211 such as a latching end in a hexagonal shape. An accommodating groove 302 is formed at the center of the innermost-depth end surface of the rear cover 301 (as shown in FIG. 5) and provided for containing and positioning a closely installed bearing 303 therein. A reduction mechanism 32 is installed in the interior of the inner circular shell 31 (as shown in FIG. 5) and driven and reduced by a plurality of layers of planetary gear sets which jointly form the reduction mechanism 32, and the inner periphery of the outer side of the inner circular shell 31 is an outwardly expanded oblique friction surface 312. A sectional shaft 33 sheathed on the long shaft 21 without being in contact (in other words, the long shaft 21 is passed through the longitudinal shaft hole of the sectional shaft 33 with a gap from the longitudinal shaft hole). An engaging gear 331, 332 and a ring-shaped engaging slot 333, 334 are formed on ring walls at both ends respectively, and a positioning hole 335 is formed on a sectional shaft, and an end of the sectional shaft 33 with the engaging gear 331 and the engaging slot 333 is extended into the central through hole 311 of the inner circular shell 31, and the engaging gear 331 and the reduction gearset 32 at the end are engaged and linked. A C-shaped retainer ring 336 is inserted into the engaging slot 333 (as shown in FIG. 5) and provided for limiting and preventing the sectional shaft 33 from being withdrawn freely. An elastic element 337, preferably a volute spring, is sheathed on the sectional shaft 33, and an end of the elastic element 337 is inserted and positioned into the positioning hole 335. A brake block 34 is made of a rubber lining material and the outer periphery of the brake block 34 is an outwardly expanded oblique friction surface 341, and a circular groove 342 is formed on the rear side of the brake block 34 (as shown in FIG. 3), and a large through hole 343 is formed at the center of the brake block 34. A disc-shaped rim 35 is made of a robust material and divided into a disc-shaped portion 351 and a rim portion 352 (as shown in FIG. 2), wherein the disc-shaped portion 351 is directly attached into the circular groove 342 of the brake block 34, and a plurality of locking elements (such as bolts and screw holes) is provided for securing the brake block 34 with the disc-shaped protrusion 35 to form a jointly rotating body, and the rim portion 352 is entered into the large through hole 343 of the brake block 34, but there is a significant spacing between the outer peripheral surface of the rim portion 352 and the inner peripheral surface of the large through hole 343, and the end surface of the outer wall of the rim portion 352 has a plurality of up-and-down bevels 353, and an end position of the outer wall has a pair of outwardly protruding convex latching bodies 354, and a rear end surface of the rim portion 352 has a circular abutting slot 355 (as shown in FIG. 3), such that during assembling, the brake block 34 and the disc-shaped protrusion 35 engaged with each other to form the jointly rotating body is sheathed on the sectional shaft 33 as shown in FIG. 5, but there is no direct linkage between the two. The other end of the elastic element 34 is abutted into the circular abutting slot 355 formed on the rear end surface of the rim portion 352 for driving the jointly rotating body to move outward.

A wedge block 36 has an engaging gear 361 installed to an inner wall of a center hole of the wedge block 36 engaged and linked with the engaging gear 332 on the ring wall of the sectional shaft 33. In other words, a direct driving and rotating relation exists between the sectional shaft 33 and the wedge block 36, a set of C-shaped retainer ring 362 is latched into the engaging slot 334 for limiting the wedge block 36 from displacing beyond the sectional shaft 33, and the wedge block 36 has a bevel 363 and a convex latching body 364 corresponsive to the bevel 353 and the convex latching body 354 of the disc-shaped rim 35 respectively, but both of the convex latching bodies 354, 364 are installed with slightly different angles. An inner housing 37 facing an end of the wedge block 36 is an opening 371 (as shown in FIG. 3), and a through hole 372 is formed at an end of the inner housing away from the wedge block 36 and the interior of the through hole 372 is corresponsive to the convex latching body 354 of the disc-shaped rim 35 and the convex latching body 364 of the wedge block 36, and an internal ring wall has a corresponsive bump 373 formed thereon.

A torque limit mechanism A is comprised of a torsion shaft 38, a friction plate 391, a brake pad 392, a disc-shaped elastic member 393, an adjustable positioning ring 394 and a positioning screw ring 395, wherein the torsion shaft 38 has an axial through slot 381 formed therein (as shown in FIG. 3), a non-circular latching slot 382 such as a hexagonal latching slot formed at a front end of the torsion shaft 38 and corresponsive to the latching end 211 of the long shaft 21, and a small section including a threaded section 383 with a reverse outer thread is formed at the middle of the outer periphery and a positioning recession 384 is formed at a front end and having a positioning cavity 385 formed thereon and penetrated to the inside in an axial direction, and the rear end has a ring wall 386. The friction plate 391 is a ring-shaped plate having a surface with a friction effect, and the brake pad 392 is a ring-shaped plate made of a lining material and having a positioning protrusion 3921 formed at the inner periphery of the brake pad 391. The disc-shaped elastic member 393 is in a concave arc shape and has a compressive elasticity. The outer periphery of the adjustable positioning ring 394 has a plurality of positioning plates 3941 selectively bent in a direction towards the positioning screw ring 395. The positioning screw ring 395 has a shaft hole 3951 with a reverse inner thread, and a plurality of symmetrical positioning grooves 3952 formed on the outer periphery for bending, pressing, and remaining the selected positioning screw plate 3941 therein respectively.

In FIG. 5, during assembling, the torsion shaft 38 is passed through the friction plate 391 and the through hole 372 of the inner housing 37, so that the friction plate 391 is attached to the ring wall 386, and then the through slot 381 of the torsion shaft 38 is sheathed on the long shaft 21, and the latching end 211 at an end of the long shaft 21 is inserted into the latching slot 382 of the torsion shaft 38 of a close connection. During the process, the end of the opening 371 of the inner housing 37 is inserted precisely into the gap between the rim portion 352 and the large through hole 343 for a non-closely connecting insertion, while the convex latching bodies 364, 354 of the wedge block 36 and the disc-shaped rim 35 are disposed adjacent to the bump 373 of the inner housing 37, and then the brake pad 392 is sheathed on the torsion shaft 38 outside the inner housing 37, and the positioning protrusion 3921 is entered into the positioning cavity 385, and then the disc-shaped elastic member 393, the adjustable positioning ring 394 and the positioning screw ring 395 are sheathed on the torsion shaft 38 sequentially, and the shaft hole 3951 of the positioning screw ring 395 is connected to the threaded section 383 through a tight screwing engagement, until the torsion shaft 38, the friction plate 391, the inner housing 37, the brake pad 392, the disc-shaped elastic member 393, the adjustable positioning ring 394 and the positioning screw ring 395 are packed tightly (in other words, the torque limit mechanism A and the inner housing 37 are packed), and the level of packing (or the number of screws used for connecting the shaft hole 3951 and the threaded section 383) can be adjusted according to the torque bearable by the power supply 20 (it is noteworthy that the torque bearable by the power supply 20 is indirectly proportional to the level of packing). After the level of packing is selected, the positioning plate 3941 of the adjustable positioning ring 394 is bent towards and pressed into the corresponsive (adjacent) positioning groove 3952 of the positioning screw ring 395 to limit and prevent the positioning screw ring 395 from being rotated and withdraw. The positioning plate 3941 not corresponsive (adjacent) to the positioning groove 3952 will not be bent. Finally, the rear cover 301 is covered, so that the positioning recession 384 of the torsion shaft 38 is entered and positioned into the inner periphery of the bearing 303 contained in the accommodating groove 302 of the rear cover 301.

When the power supply 20 is turned on (regardless of outputting a forward power or a reverse power), the long shaft 21 is driven to rotate by the power supply 20, and the torque limit mechanism A and the inner housing 37 are synchronously rotated by the close connection between the latching end 211 and the latching slot 382, and then the bump 373 inside the inner housing 37 pushes the convex latching bodies 354, 364 to rotate synchronously. Since the engaging gear 361 of the wedge block 36 and the engaging gear 332 on the ring wall of the sectional shaft 33 are engaged and linked with each other, the sectional shaft 33 is driven to rotate, so as to provide a predetermined deceleration effect of the reduction mechanism 32 and drive the cable wheel 40 to rotate and release a cable (not shown in the figure) or retrieve the cable.

When the power supply 20 is turned off (through a manual control/operation or a power failure), the long shaft 21, the torque limit mechanism A and the inner housing 37 will be stopped immediately, and then the cable of the cable wheel 40 carrying a load will produce a reverse torque, and the linkage of the cable and the reduction mechanism 32 pushes the sectional shaft 33 and the wedge block 36 to produce a reverse rotation, so that the convex latching body 364 of the wedge block 36 is separated with respect to the bump 373 inside the inner housing 37, and the bevel 363 of the wedge block 36 momentarily press the bevel 353 of the disc-shaped rim 35, so that the disc-shaped rim 35 is moved quickly towards the inner circular shell 31, and the oblique friction surface 341 of the brake block 34 is attached quickly to the oblique friction surface 312 of the inner circular shell 31 to produce a braking effect for braking the brake block 34 and stopping the wedge block 36, the sectional shaft 33, the reduction mechanism 32 and the cable wheel 40 with the cable accordingly.

The power supply 20 regardless of being turned on or off will produce a reverse torque as long as the cable is loaded. When the reverse torque produces the brake effect and/or the power supply 20 is capable of bearing the torque, then there will be no problem for the application. However, if the reverse torque produces the brake effect and/or reaches a level almost not bearable by the power supply 20, then the reverse torque will force the wedge block 36 to push the inner housing 37 to rotate in a reverse direction. Now, the torsion shaft 38 is stopped together with the power supply 20, so that rotation of the inner housing 37 will force the friction plate 391 to rotate altogether, but the torsion shaft 38 and the brake pad 392 will be released from the compressed status with the inner housing 37 to remain still, so as to protect the power supply 20 from being damaged.

A power winch 1 in accordance with the second preferred embodiment of the present invention has the same structural look and effects as the embodiment as shown in FIG. 1, and thus they will not be repeated, and the same element of both first and second preferred embodiments adopts the same name and numeral for simplicity. The difference between these two preferred embodiments resides on that the torque limit mechanism of the second preferred embodiment is installed in the assembly of the reduction mechanism. With reference to FIGS. 6 to 9 for the power winch 1 of the second preferred embodiment of the present invention, after the rear cover 301 and the inner circular shell 31 of the reduction gearbox 30 are removed, a second inner circular shell 43 and a first planetary gear set 321 are exposed, and the inner periphery of the second inner circular shell 43 is an inner gear 431, and the first planetary gear set 321 is the first layer of the reduction mechanism 32 and comprised of three identical small gears, and the center shaft is jointly inserted into a base 41 and a cover 42 and they are arranged into a triangular shape, wherein the base 41 has a through hole 411 formed at the center of the base 41, a large accommodating slot 412 formed on a side of the base 41 facing the small gears, and a plurality of small cavities 413 formed at the inner periphery of the base 41, and three insert holes 414 are formed around. The cover 42 has a through hole 421 formed at the center of the cover 42 and three insert holes 424 formed around the periphery of the cover 42, such that during assembling, the insert holes 414, 424 are provided for inserting and positioning the center shaft at both ends of the three small gears, and the through holes 411, 421 are configured to be corresponsive to the insert holes 414, 424 respectively.

A torque limit mechanism B, is comprised of a torsion shaft 48, a friction plate 491, a brake pad 492, a disc-shaped elastic member 493, an adjustable positioning ring 494 and a positioning screw ring 495, wherein the torsion shaft 48 has an axial through slot 481 formed therein and provided for passing the through the long shaft 21 with spacing, and a small section of the outer periphery has a threaded section 483 with a reverse outer thread, and a positioning cavity 485 is formed at a selected position of the outer periphery and penetrated to the inside in an axial direction, and its rear end has an engaging gear 486. The friction plate 491 is a ring-shaped plate having a surface with a friction effect, and the outer periphery further includes a plurality of small flanges 4911, and the friction plate 491 and the small flanges 4911 have sizes precisely corresponsive to those of the large accommodating slot 412 and the small cavity 413 of the base 41. The brake pad 492 is a ring-shaped plate made of a lining material, and its inner periphery has a positioning protrusion 4921. The disc-shaped elastic member 493 is substantially in a concave arc shape and has a compressive elasticity. The outer periphery of the adjustable positioning ring 494 has a plurality of positioning plates 4941 which can be selectively bent towards the positioning screw ring 495. The positioning screw ring 495 has a shaft hole 4951 with a reverse inner thread, and a plurality of symmetrical positioning grooves 4952 formed at the outer periphery and provided for bending, pressing and remaining the selected positioning screw plate 4941.

Figure 9:
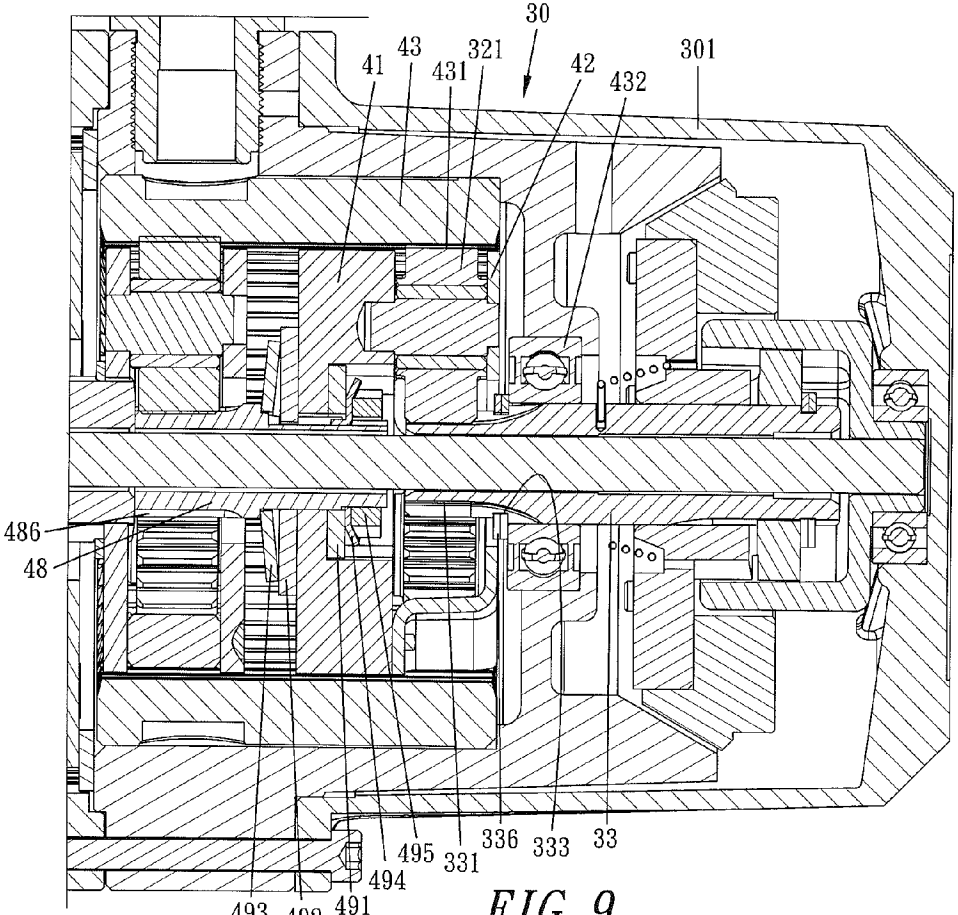
FIG. 9 is a cross-sectional view of the second preferred embodiment of the present invention.
Figure 10:
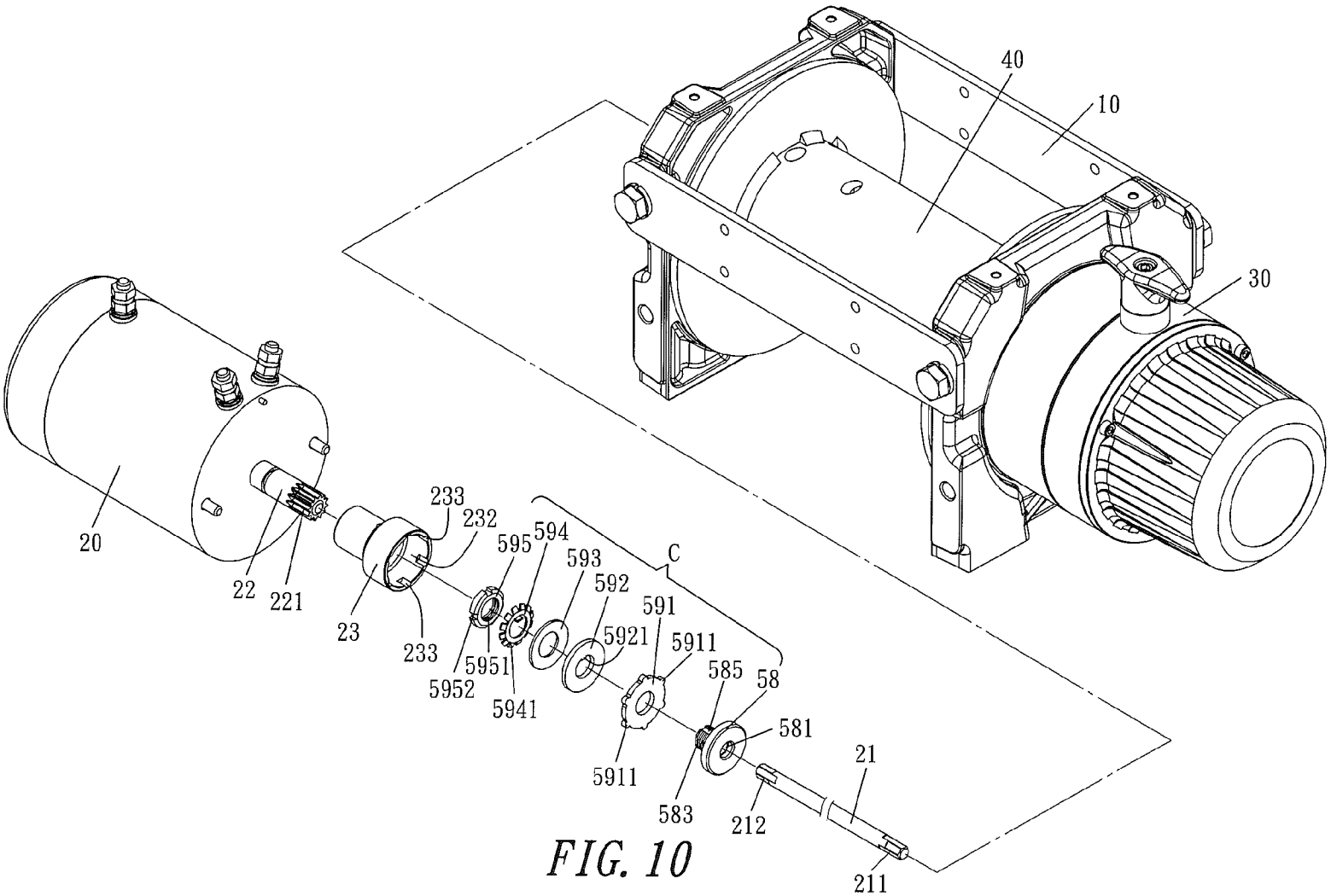
FIG. 10 is an exploded view of a third preferred embodiment of the present invention.
Figure 11:
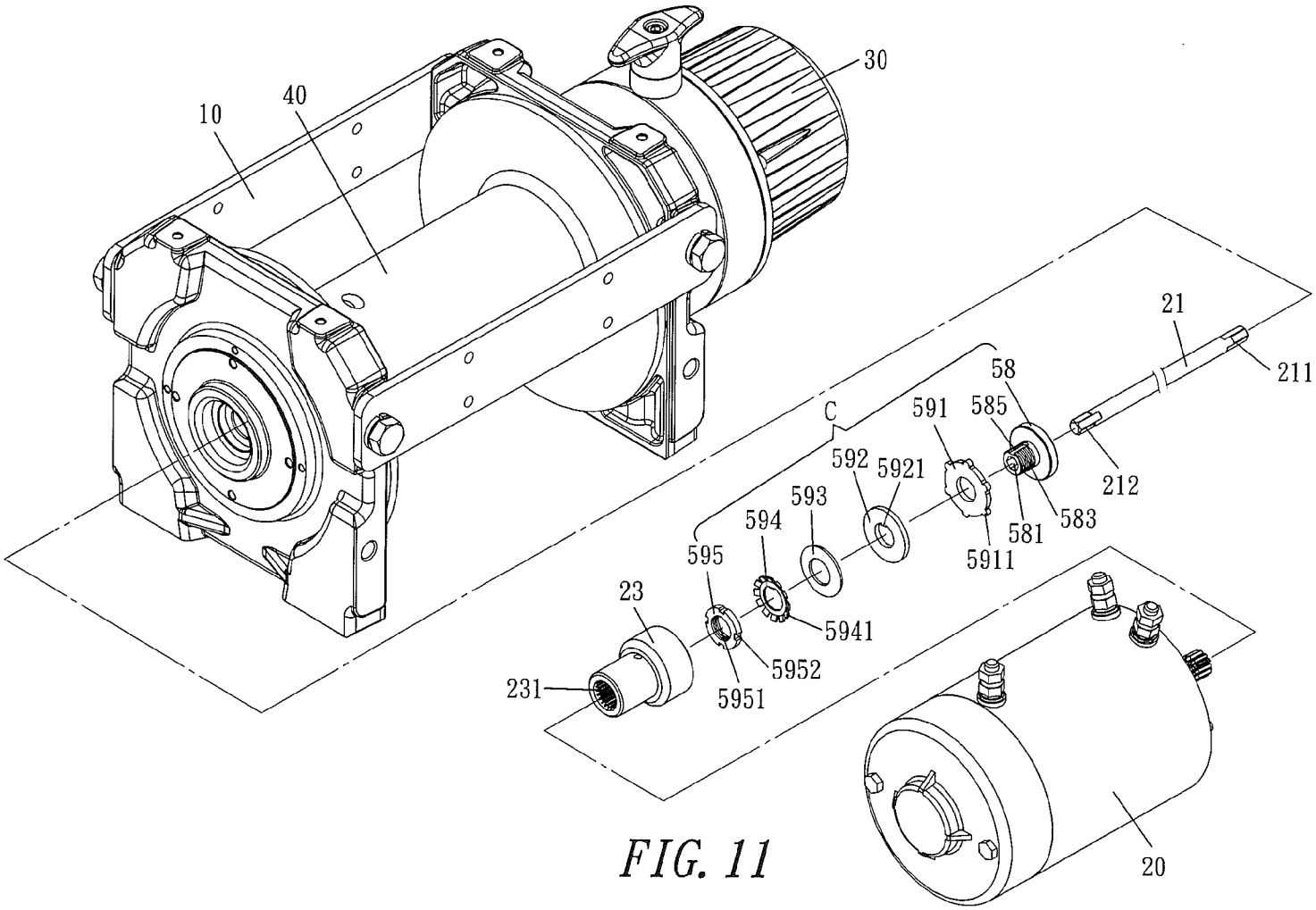
FIG. 11 is an exploded view of the third preferred embodiment of the present invention viewing from another angle.
Figure 12:
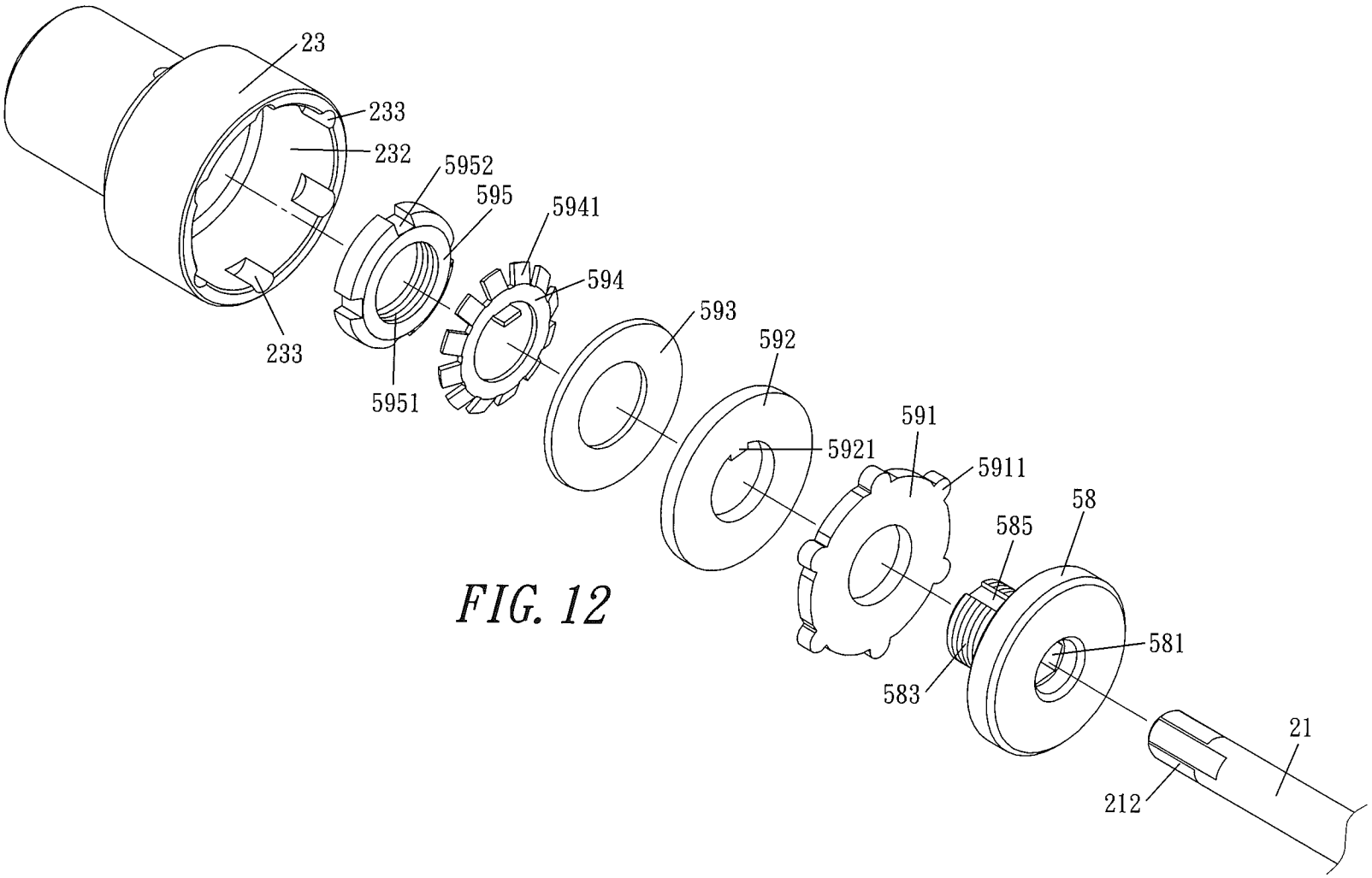
FIG. 12 is an exploded view of a torque limit mechanism of the third preferred embodiment of the present invention.

In FIG. 9, during assembling, the torsion shaft 48 is passed through the disc-shaped elastic member 493 and the brake pad 492, and the positioning protrusion 4921 of the brake pad 492 is entered into the positioning cavity 485 of the torsion shaft 48, and then the torsion shaft 48 is passed through the through hole 411 of the base 41, so that the brake pad 492 is attached onto the back side of the base 41, and then the friction plate 491 is contained into the large accommodating slot 412 of the base 41 by corresponding the small flanges 4911 with the small cavities 413 in a one-to-one correspondence, so as to allow the torsion shaft 48 to pass through, and then the adjustable positioning ring 494 and the positioning screw ring 495 are sheathed on the torsion shaft 48 sequentially, and the shaft hole 4951 of the positioning screw ring 495 and the threaded section 483 are connected with a tight screwing engagement, until the torsion shaft 48, the disc-shaped elastic member 493, the brake pad 492, the base 41, the friction plate 491, the adjustable positioning ring 494 and the positioning screw ring 495 are packed (in order words, the torque limit mechanism B and the base 41 are packed). Of course, the level of packing (or the quantity of screws used for connecting the shaft hole 4951 and the threaded section 483) may be adjusted according to the torque bearable by the power supply 20 (it is noteworthy that the torque bearable by the power supply 20 is directly proportional to the level of packing). After the level of packing is selected, the positioning plate 4941 of the adjustable positioning ring 494 is bent towards the corresponsive (adjacent) positioning groove 4952 of the positioning screw ring 495 to limit and prevent the positioning screw ring 495 from being rotated and withdrawn. The positioning plate 4941 not corresponsive (adjacent) to the positioning groove 4952 will not be bent. Finally, the base 41 and the three small gears and the cover 42 are assembled into the first planetary gear set 321, and then the first planetary gear set 321 including the torque limit mechanism B is put into the second inner circular shell 43, so that the outermost teeth of the three small gears are engaged with the inner teeth 431 of the second inner circular shell 43, while the engaging gear 486 of the torsion shaft 48 is being extended into the second inner circular shell 43 and coupled with any other layer of the planetary gear set of the reduction mechanism 32 installed further inside the second inner circular shell 43. After an end of the aforementioned sectional shaft 33 having the engaging gear 331 and the engaging slot 333 is extended into the central through hole 311 of the inner circular shell 31, the end of the sectional shaft 33 is supported by a bearing 432, and the C-shaped retainer ring 336 is inserted into the engaging slot 333 (as shown in FIGS. 5 and 10), for limiting the sectional shaft 33 from being withdrawn freely. In the process, the engaging gear 331 of the sectional shaft 33 is inserted into a space enclosed by the three small gears, and the engaging gear 331 is engaged with the innermost teeth of the three small gears. Finally, the inner circular shell 31 and the rear cover 301 are used for the covering purpose.

After the power supply 20 is turned on (regardless of outputting a forward power or a reverse power), and the power is supplied to the sectional shaft 33, the three small gears of the first planetary gear set 321 are driven to rotate around the inner teeth 431 of the second inner circular shell 43, so that the whole first planetary gear set 321 is rotated. Now, the torque limit mechanism B and the base 41 are situated at a compressed status, so that the torque limit mechanism B is rotated synchronously with the first planetary gear set 321. When the power supply 20 is turned off (by manual control or operation, or by power failure), the first planetary gear set 321 and the torque limit mechanism B will be stopped immediately, and the reverse torque produced by the carrying load pushes the torque limit mechanism B and the first planetary gear set 321 to produce a reverse rotation through the linkage with the cable and another layer planetary gear set on the reduction mechanism 32. If the reverse torque is not bearable by the power supply 20, then the reverse torque will force the torsion shaft 48 to rotate in a reverse direction. Now, the sectional shaft 33 and the first planetary gear set 321 are stopped with the power supply 20, therefore the reverse rotation of the torsion shaft 48 will force the brake pad 492 to rotate altogether but the base 41 and the friction plate 491 will be separated from the compressed status with the brake pad 492 and will remain still, so as to protect the power supply 20 from being damaged.

A power winch 1 in accordance with the third preferred embodiment of the present invention has the same structural look and effects as the embodiment as shown in FIG. 1, and thus they will not be repeated, and the element of the third preferred embodiment same as that of the first and second preferred embodiments adopts the same name and numeral for simplicity. The difference between the third preferred embodiment and the first and second preferred embodiments resides on that the torque limit mechanism of the third preferred embodiment is installed when the power supply outputs power.

With reference to FIGS. 10 to 13 for the power winch 1 in accordance with the third preferred embodiment of the present invention, an engaging gear 221 is installed at a front end of the center shaft 22 of the power supply 20; a sleeve 23 is formed at an end of an ring-shaped inner engaging tooth 231 corresponsive to the center shaft 22, and the engaging gear 221 of the center shaft 22 is engaged with the inner engaging tooth 231 of the sleeve 23, so that the sleeve 23 and the center shaft 22 are connected, and a large accommodating slot 232 is formed at an end of the sleeve 23 away from the center shaft 22, and the outermost section of the inner periphery further has a plurality of small cavities 233;

A torque limit mechanism C is comprised of a torsion shaft 58, a friction plate 591, a brake pad 592, a disc-shaped elastic member 593, an adjustable positioning ring 594 and a positioning screw ring 595, wherein the torsion shaft 58 contains a latching slot 581 substantially in a non-circular shape (such as a hexagonal shape) in the axial direction and provided for engaging an end of the non-circular (or hexagonal) latching end 212 corresponsive to the long shaft 21, and a small section of the outer periphery of the torsion shaft 58 has a threaded section 583 with a reverse outer thread, and a positioning cavity 585 formed at a selected position of the outer periphery and penetrated into the inside in an axial direction; the friction plate 591 is a ring-shaped plate having a surface with a friction effect, and the outer periphery further has a plurality of small flanges 5911, and the friction plate 591 and the small flanges 5911 have sizes precisely corresponsive to those of the large accommodating slot 232 and the small cavity 233 of the sleeve 23; the brake pad 592 is a ring-shaped plate made of a lining material, and has a positioning protrusion 5921 formed at the inner periphery; the disc-shaped elastic member 593 is substantially in a concave arc shape and has a compressive elasticity; the outer periphery of the adjustable positioning ring 594 has a plurality of positioning plates 5941 which can be selectively bent towards the positioning screw ring 595; the positioning screw ring 595 has a shaft hole 5951 with a reverse inner thread, and a plurality of symmetrical positioning grooves 5952 formed at the outer periphery for bending, pressing and remaining the selected positioning screw plate 5941.

Figure 13:
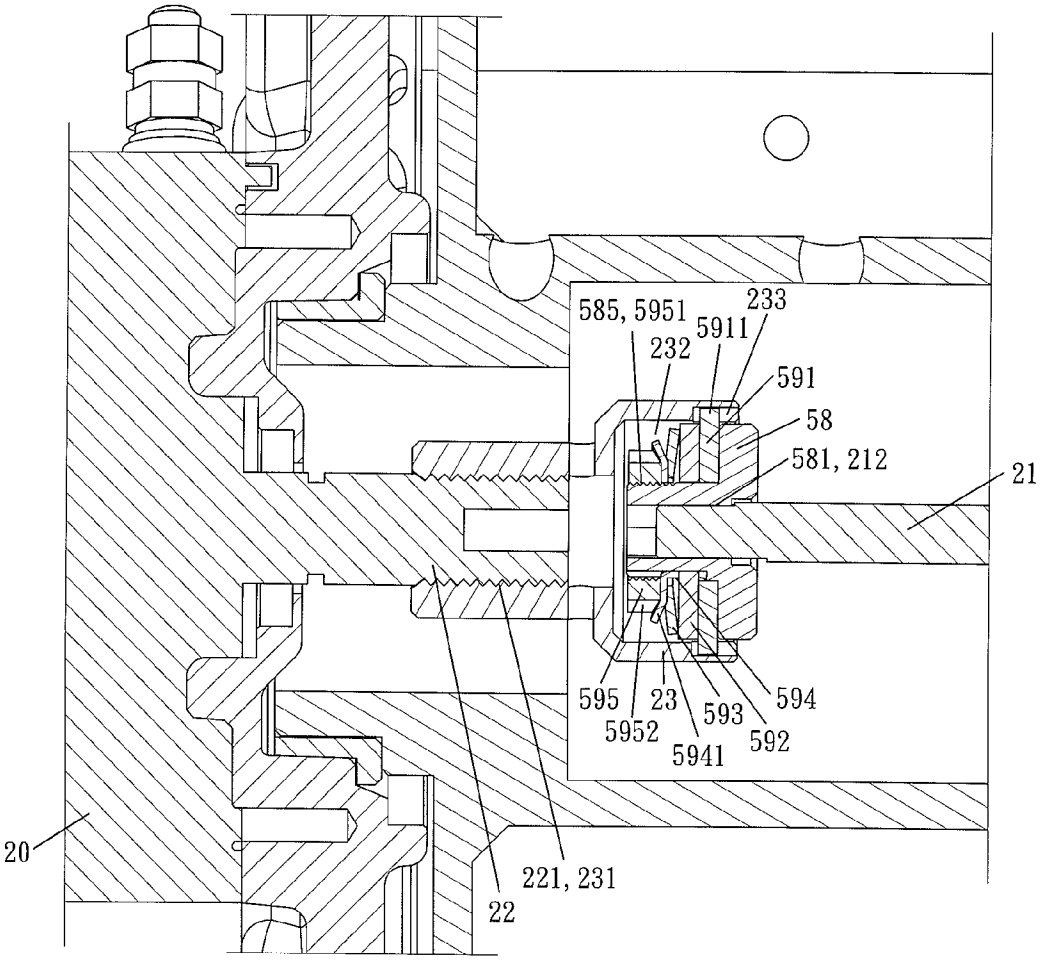
FIG. 13 is a cross-sectional view of the third preferred embodiment of the present invention.

In FIG. 13, during assembling, the torsion shaft 58 is passed through the friction plate 591, the brake pad 592, the disc-shaped elastic member 593, the adjustable positioning ring 594 and the positioning screw ring 595, so that the friction plate 591 is attached onto the back side of a disc-shaped area of the torsion shaft 58, and the positioning protrusion 5921 of the brake pad 592 is entered into the positioning cavity 585 of the torsion shaft 58, and the shaft hole 5951 of the positioning screw ring 595 and the threaded section 583 of the torsion shaft 58 are connected with a tight screwing engagement, until the torsion shaft 58, the friction plate 591, the brake pad 592, the disc-shaped elastic member 593, the adjustable positioning ring 594 and the positioning screw ring 595 are packed (in other words, the torque limit mechanism C is packed closely), and its level of packing (or the quantity of screws used for connecting the shaft hole 5951 and the threaded section 583) may be adjusted according to the torque bearable by the power supply 20 (it is noteworthy that the torque bearable by the power supply 20 is indirectly proportional to the level of packing). After the level of packing is selected, the positioning plate 5941 of the adjustable positioning ring 594 is bent and pressed into the corresponsive (adjacent) positioning groove 5952 of the positioning screw ring 595 to limit and prevent the positioning screw ring 595 from being rotated and withdrawn. The positioning plate 5941 not corresponsive (adjacent) to the positioning groove 5952 will not be bent. Finally, the torque limit mechanism C is contained in the large accommodating slot 232 of the sleeve 23, and the plurality of small flanges 5911 of the friction plate 591 are inserted and positioned into the small cavities 233 of the sleeve 23 in a one-to-one correspondence, and provided for inserting the latching end 212 of the long shaft 21 into the latching slot 581 of the torsion shaft 58 to achieve a connection, and the latching end 211 at the other end of the long shaft 21 is inserted at a corresponsive connecting position, therefore both ends of the long shaft 2 are limited from being separated freely.

When the power supply 20 is turned on (regardless of outputting a forward power or a reverse power), and the power is supplied from the center shaft 22 to the sleeve 23, the torque limit mechanism C is packed and the plurality of small flanges 5911 of the friction plate 591 are inserted and packed into the small cavities 233 of the sleeve 23 in a one-to-one correspondence, and the latching end 212 of the long shaft 21 is inserted into the latching slot 581 of the torsion shaft 58 to achieve a connection, and the torque limit mechanism C and the long shaft 21 are driven by the sleeve 23 to rotate synchronously. When the power supply 20 is turned off (by manual control or operation, or by power failure), the sleeve 23 and the long shaft 21 will be stopped immediately, but the reverse torque produced by a carrying load will push the long shaft 21 but the linkage of the cable and the reduction mechanism 32, so that the torque limit mechanism C and the sleeve 23 produce a reverse rotation. If the reverse torque is not bearable by the power supply 20, then the reverse torque will force the torsion shaft 58 to rotate in a reverse direction. Now, the sleeve 23 is stopped together with the power supply 20, so that the reverse rotation of the torsion shaft 58 will force the brake pad 592 to rotate accordingly, but the sleeve 23 and the friction plate 591 are released from the compressed status with the brake pad 592 and remain still, so as to protect the power supply 20 from being damaged.

In view of the aforementioned three preferred embodiments of the present invention, a torque limit mechanism is selectively installed in a power winch during a power transmission process for outputting power from the power supply 20 and transmitting the power through the long shaft 21 to the reduction mechanism 32, and the torque limit mechanism is installed before the power is supplied to the reduction mechanism inside the reduction gear (in order word, it is installed at the front end of the reduction mechanism), installed directly in the assembly of the reduction mechanism, or installed when the power supply outputs power, so that if the reverse torque produced by the carrying load of the power winch exceeds the reverse torque bearable by the power supply, the power transmission will be cut off immediately to assure that the use of the power supply 20 will not exceed the loading capacity, so as to prevent the power winch from being damaged.

What is claimed is:

1. A torque limiter for a power winch, comprising: a frame, a power supply installed on a side of the frame and capable of outputting power; a reduction gearbox installed on the other side of the frame and including a reduction mechanism installed therein, and a long shaft being driven to rotate by the power of the power supply to provide a reduction effect, and an end of the long shaft forming a latching end; a cable wheel installed at the middle of the frame and driven to rotate by the power outputted by the reduction gearbox; and a torque limit mechanism being installed in a process of transmitting power from the power supply to the reduction mechanism through the long shaft; wherein in that the torque limit mechanism is comprised of a torsion shaft, a friction plate, a brake pad, a disc-shaped elastic member, an adjustable positioning ring, and a positioning screw ring, wherein the torsion shaft includes an axial through slot formed therein, a latching slot formed at a front end of the torsion shaft, a threaded section formed on an outer periphery of the torsion shaft, and positioning cavity axially and deeply penetrated into the torsion shaft; the friction plate is a ring-shaped plate with friction surfaces; the brake pad is a ring-shaped plate made of a lining material and having a positioning protrusion formed at the inner periphery of the brake pad; the disc-shaped elastic member is substantially in a concave arc shape and has compressive elasticity; the outer periphery of the adjustable positioning ring includes a plurality of positioning plates and selectively bent in a direction towards the positioning screw ring; the positioning screw ring has a shaft hole with a reverse inner thread, and the outer periphery has a plurality of symmetrical positioning grooves formed thereon and provided for deviating, pressing, and remaining the selected positioning plate therein.

2. The torque limiter for a power winch according to claim 1, wherein the torque limit mechanism has an inner housing installed in front of the reduction mechanism in the reduction gear for entering power and coupled to the reduction mechanism, and a through hole formed at an end of the inner housing, and during assembling, the torsion shaft is passed through the friction plate and the through hole of the inner housing, so that the friction plate is attached to the torsion shaft, and the through slot of the torsion shaft is sheathed on the long shaft, and a latching end at an end of the long shaft is inserted into and closely coupled to the latching slot of the torsion shaft, and the brake pad is mounted onto the torsion shaft outside the inner housing, and the positioning protrusion is entered into the positioning cavity, and the disc-shaped elastic member, the adjustable positioning ring and the positioning screw ring are sheathed on the torsion shaft sequentially, and the shaft hole of the positioning screw ring is screwed and coupled to the threaded section, until the torsion shaft, the friction plate, the inner housing, the brake pad, the disc-shaped elastic member, the adjustable positioning ring and the positioning screw ring are packed tightly, and the positioning plate of the adjustable positioning ring is bent and pressed into the corresponsive positioning groove of the positioning screw ring to limit and prevent the positioning screw ring from being rotated or withdrawn.

3. The torque limiter for a power winch according to claim 1, wherein the torque limit mechanism is installed in the assembly of the reduction mechanism, and the reduction mechanism has a first planetary gear set comprising three identical small gears with the long shaft inserted into a base and a cover and arranged into a triangular shape, and the base has a through hole formed at the center of the base, and a large accommodating slot formed on a surface of the base and facing the small gears and connected to plurality of small cavities formed on the inner periphery of the base; and the cover has a through hole corresponsive to the through hole of the base, and the outer periphery of the friction plate further includes a plurality of small flanges, such that during assembling, the torsion shaft is passed through the disc-shaped elastic member and the brake pad, and the positioning protrusion of the brake pad is entered into the positioning cavity of the torsion shaft, and then the torsion shaft is passed through the through hole of the base, so as to attach the brake pad onto the back side of the base, and the friction plate is contained into the large accommodating slot of the base in the manner of corresponding the small flanges one by one to the small cavities and provided for passing the torsion shaft, and then the adjustable positioning ring and the positioning screw ring are sheathed on the torsion shaft sequentially, so that the shaft hole of the positioning screw ring is screwed and engaged with the threaded section until the torsion shaft, the disc-shaped elastic member, the brake pad, the base, the friction plate, the adjustable positioning ring and the positioning screw ring are packed closely, and the positioning plate of the adjustable positioning ring is bent and pressed into the corresponsive positioning groove of the positioning screw ring to limit and prevent the positioning screw ring from being rotated and withdrawn.

4. The torque limiter for a power winch according to claim 1, wherein when the torque limit mechanism is installed at the power supply that outputs power, a sleeve is coupled to the center shaft of the power supply, and a large accommodating slot is formed at an end of sleeve away the shaft, and the outermost section of the inner periphery of the large accommodating slot has a plurality of small cavities, and the outer periphery of the friction plate has a plurality of small flanges, such that during assembling, the torsion shaft is passed through the friction plate, the brake pad, the disc-shaped elastic member, the adjustable positioning ring and the positioning screw ring sequentially, so that the friction plate is attached onto the torsion shaft, and the positioning protrusion of the brake pad is entered into the positioning cavity of the torsion shaft, and the shaft hole of the positioning screw ring is screwed and engaged with the threaded section of the torsion shaft until the torsion shaft, the friction plate, the brake pad, the disc-shaped elastic member, the adjustable positioning ring and the positioning screw ring are packed closely, and the positioning plate of the adjustable positioning ring is bent and pressed into the corresponsive positioning groove of the positioning screw ring to limit and prevent the positioning screw ring from being rotated and withdrawn, and then the torque limit mechanism is contained in the large accommodating slot of the sleeve, and the small flanges of the friction plate are inserted and positioned into the small cavities of the sleeve in one-to-one correspondence, and the latching end of the long shaft is inserted into the latching slot of the torsion shaft for a connection.

* * * * *